United States Patent [19]

Fehler et al.

[11] 4,036,582

[45] July 19, 1977

[54] COMBUSTION CHAMBER FOR GAS TURBINE POWER PLANTS HAVING DEVICES FOR THE GASEOUS PROCESSING OF THE FUEL BEING INTRODUCED THEREIN

[75] Inventors: Adolf Fehler, Pfaffing; Günter Kirschey, Munich, both of Germany

[73] Assignee: Motoren- und Turbinen-Union Munchen GmbH, Munich, Germany

[21] Appl. No.: 627,918

[22] Filed: Oct. 31, 1975

[30] Foreign Application Priority Data

Nov. 2, 1974 Germany ..... 2452178

[51] Int. Cl.[2] ..... F23Q 9/08

[52] U.S. Cl. ..... 431/352; 60/39.65; 60/39.71; 431/116

[58] Field of Search ..... 431/352, 353, 354, 217, 431/115, 9; 239/648, 653, 657, 674, 689, 432, 39.65, 39.71, 419, 427.3; 60/39.65, 39.71

[56] References Cited

U.S. PATENT DOCUMENTS 3,589,128 6/1971 Sweet ..... 431/352

3,593,518 7/1971 Gerrard ..... 431/352

*Primary Examiner*—William F. O'Dea

*Assistant Examiner*—Robert J. Charvat

[57] ABSTRACT

A combustion chamber for gas turbine engines or power plants having devices for the gaseous processing of the fuel which is introduced therein, characterized by the combination of the following features:

a. The fuel ejection cone of at least one fuel nozzle arranged upstream of the flame tube back wall of the combustion chamber extends exteriorly along the flame tube backwall, the latter of which is conically shaped in conformance with the ejection cone;

b. The combustion chamber has an air infeed hood essentially encompassing at least partially the flame tube backwall as well as the fuel nozzle, forming an annular or ring channel narrowing in the direction of the downstream end of the flame tube backwall and which, by means of plurality of apertures located immediately behind the flame tube backwall in the side walls of the flame tube, is in communication with the interior of the flame tube.

5 Claims, 1 Drawing Figure

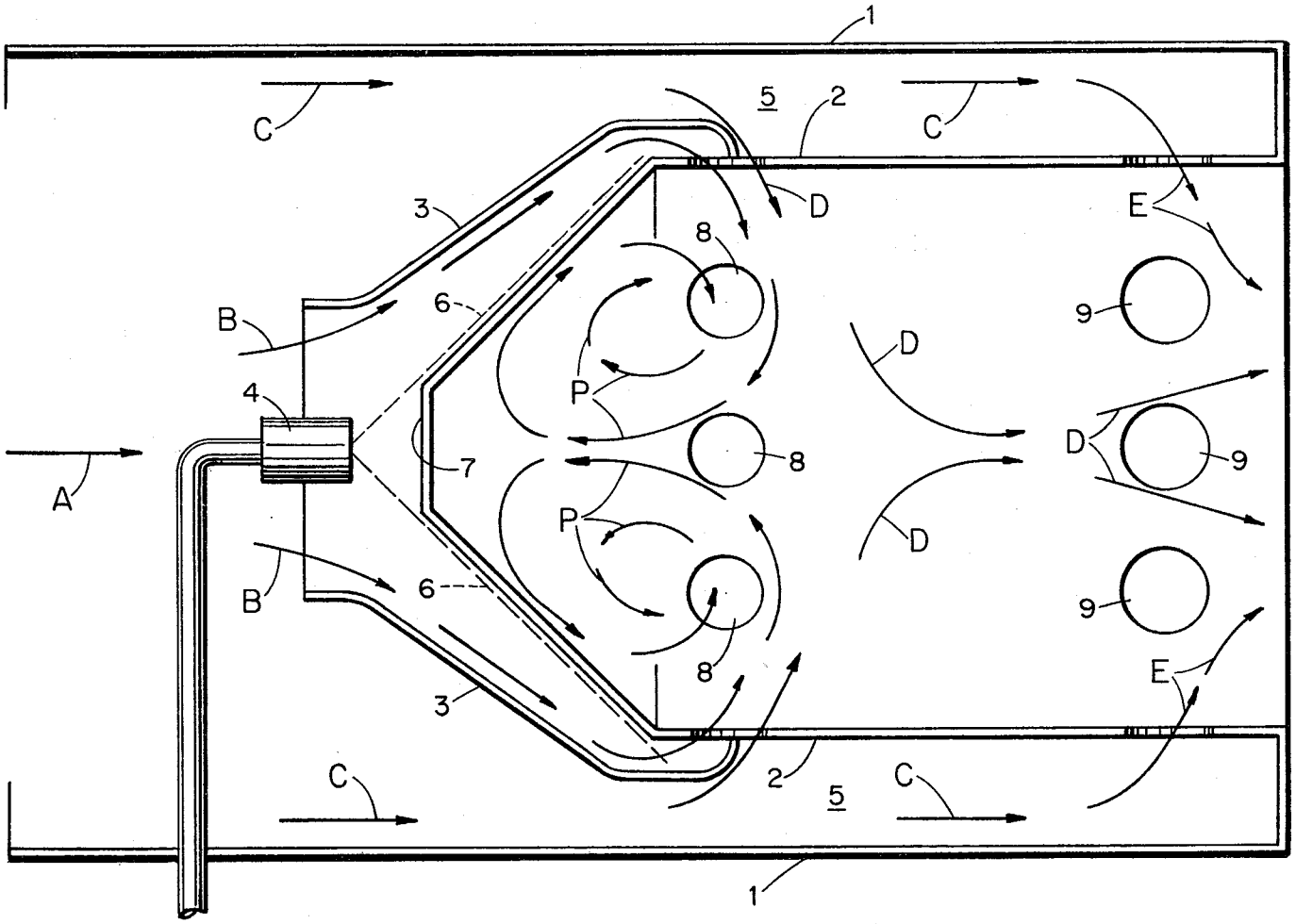
1
2
5
C
D
E
9
8
P
6
7
3
B
4
A

COMBUSTION CHAMBER FOR GAS TURBINE POWER PLANTS HAVING DEVICES FOR THE GASEOUS PROCESSING OF THE FUEL BEING INTRODUCED THEREIN

FIELD OF THE INVENTION

The present invention relates to a combustion chamber for gas turbine engines or power plants having devices for the gaseous processing of the fuel which is introduced therein.

DISCUSSION OF THE PRIOR ART

In known types of constructions of combustion chambers for gas turbine power plants, for example, the fuel is finally atomized under high pressure by means of known simplex-and duplex nozzles and injected into the primary zone, in which it arrives prepared, meaning in a vaporous condition, so as to be finally combusted, or arrives by means of air atomizing nozzles in the primary zone, whereby the fuel has air admixed therewith within the nozzle so as to shorten the preparation process.

Also known is the fuel infeed and preparation by means of different types of the so-called "vaporizer-burners" in which the fuel due to a high wall temperature caused by the combustion process and the flow relationships reaches a gaseous condition within the burner and is premixed with air.

The vaporizer-burners, amongst others, provide for T-shaped or cane grip-like shaped vaporizer tube bodies.

An important disadvantage of these known vaporize-burners is that the vaporizer tube bodies, while requiring a relatively high construction volume within the combustion chamber, nevertheless afford only a relatively small surface for the fuel atomization so that, as a rule, only about 8 to 10percent of the infed fuel can actually be atomized.

The mentioned fuel injection and preparation systems have the further disadvantage that the combustion emanates more or less from a single point, so that forcing of the mixing sequences possible through only considerable constructional requirement renders attainable a uniform temperature output profile.

Furthermore, this type of point-like fuel injection requires relatively long combustion chambers in order to be able to obtain a spatially uniform fuel preparation and thereby uniform combustion or, however, requires thereby a primary zone turbulence of fuel and air components, in order to form, in the primary zone, a relatively uniform combustion, with the further result of an increased pressure and consequent power losses.

SUMMARY OF THE INVENTION

Accordingly, it is an object of the present invention to eliminate the disadvantages which are produced in the above-mentioned installations for the infeed and preparation of the fuel, and to create a combustion chamber of gas turbine engines or power plants by means of which there is attainable, in a relatively uncomplicated manner in comparison with known constructions, an essentially higher rate of vaporization or atomization of the fuel under requirement of an extremely low combustion chamber volume or, respectively, a short combustion chamber length.

Within the scope of the foregoing object there is thus further attainable, through the optimum preparation of the fuel-air mixture, a uniform combustion which is to the greatest extent free of deleterious materials, as well as a uniform temperature profile at the combustion chamber outlet.

Furthermore, in comparison with known constructions, there is facilitated a higher combustion chamber loading or charging.

For the solution of the foregoing task, the invention is primarily characterized by the combination of the following features:

a. The fuel ejection cone of at least one fuel nozzle arranged upstream of the flame tube back wall of the combustion chamber extends exteriorly along the flame tube backwall, the latter of which is conically shaped in conformance with the ejection cone;

b. The combustion chamber has an air infeed hood essentially encompassing, at least partially, the flame tube backwall as well as the fuel nozzle, forming an annular or ring channel narrowing in the direction of the downstream end of the flame tube backwall, and which, by means of plurality of apertures located immediately behind the flame tube, is in communication with the interior of the flame tube.

BRIEF DESCRIPTION OF THE DRAWING

Further details of the invention may now be ascertained by means of a longitudinal sectional view taken through a combustion chamber, as shown in the accompanying single FIGURE of the drawing.

DETAILED DESCRIPTION

The illustrated combustion chamber consists of an external housing 1 having a flame tube 2 located therein, the latter of which is connected with an air infeed hood 3 into which there centrally projects a fuel nozzle 4. The combustion chamber is fed with compressed air in the direction of arrow A from a gas turbine power plant (not shown in the drawing). The introduced compressed air divides itself into combustion air (arrows B) introduced through the air infeed hood 3, and mixing air (arrows C), within a secondary passageway 5 formed between the external housing 1 and the flame tube 2.

The fuel ejection or spray cone 6 which emanates from the fuel nozzle 4 exteriorly moistens the backwall of conical flame tube 7 uniformly over its entire circumference.

Since the combustion, by means of the radial introduction of the fuel-air mixture, should primarily take place within the region which is encompassed by the flame tube backwall 7, essentially within the head portion of the combustion chamber, in practice there can be calculated to be present a wall temperature at the flame tube backwall of 900° C and above. The large conical surface of the flame tube backwall 7 and the relatively high wall temperature thus lead to an optimum atomization or vaporization of the fuel. Concurrently, the vaporization of the fuel effectuates a cooling of the flame tube backwall 7.

The fuel nozzle 4 which is located exteriorly of the flame tube 2 facilitates that the smallest fuel quantities (fuel pressures less than 1 atmosphere) may still be carried out uniformly at the circumference with respect to apertures 8 in the side walls of the flame tube 2 partially covered by means of the air infeed hood 3 relative to the secondary air passageway in the combustion zone. Prior to entry into the flame tube 2, there thus intensively mixes the gaseous fuel with the primary air which is introduced by means of the air infeed hood 3, (arrows B), and thus leads to a spatially short, uniform combustion of a homogeneous mixture of gases, so as to deliver exhaust gases which are particularly free of deleterious materials.

The relatively high velocity of the fuel-air mixture at streaming into the combustion zone, amongst other things, prevents an igniting of the gas mixture externally of the combustion chamber.

The primary zone turbulences which are constituted by the gaseous fuel-air mixture are shown by arrows P and are essentially created due to the fuel-air streams impinging at relatively high speeds at approximately the middle of the flame tube.

The primary zone turbulences P fill the primary zone located essentially within the flame tube backwall almost completely, and thereby extensively prevent deposit of fuel residuals on the flame tube backwall and, consequently, any soot or carbon formation.

Through the cross-sectional half of the apertures 8 not covered by the air infeed hood 3, a portion of mixing air C flowing through the secondary passageway is conveyed towards the center of the flame tube (arrows D), for equalizing the temperature profile over the entire flame tube cross-section.

The remaining portion of the mixing air C is transmitted, in accordance with the direction of arrows E, through further apertures 9 located downstream in the flame tube 2 so as to somewhat reduce the combustion chamber outlet temperature and to attain, together with the diverging mixing air streams D, a uniform temperature profile at the combustion chamber outlet.

The exemplary embodiment according to the drawing represents a single combustion chamber or, respectively, a tube combustion chamber.

However, the invention is also suited for other types of combustion chambers, for example, combined ring-tube combustion chambers, in which the combustion chamber external housing is arranged so as to extend coaxially with respect to the longitudinal axis of a gas turbine engine or power plant, and a plurality of flame tubes are located within the external housing at uniform spacings relative to each other.

Furthermore, the invention is also applicable to pure ring combustion chambers, wherein the air infeed hood may similarly be ring-shaped and coaxial to the longitudiinal axis of the power plant.

While there has been shown what is considered to be the preferred embodiment of the invention, it will be obvious that modifications may be made which come within the scope of the disclosure of the specification.

What is claimed is:

1. In a combustion chamber for gas turbine power plants including means for the gaseous processing of the fuel being introduced therein, the combination of:

a. said combustion chamber having a flame tube with an essentially conically shaped flame tube backwall; and at least one fuel ejection nozzle located upstream of said flame tube backwall, said nozzle ejecting a fuel cone extending exteriorly along said flame tube backwall, the conical configuration of said backwall being substantially similar to that of said fuel cone;

b. and an air infeed hood surrounding said flame tube backwall and at least partly said fuel ejection nozzle, said hood and said flame tube backwall forming an annular passageway decreasing in cross-section in the downstream direction of said flame tube backwall; and a plurality of apertures in the side walls of said flame tube arranged directly adjacent said flame tube backwall and providing communication between said annular passageway with the interior of said flame tube.

2. A combustion chamber as claimed in claim 1, including a secondary air passageway extending around said flame tube, said apertures in the side walls of said flame tube having about one-half thereof screened off from said air passageway by said air infeed hood.

3. A combustion chamber as claimed in claim 2 wherein said flame tube is provided with a second plurality of apertures therein at a location downstream of the first said apertures.

4. A combustion chamber as claimed in claim 2 wherein said flame tube is cylindrical downstream of said backwall.

5. A combustion chamber as claimed in claim 2 comprising a housing surrounding said air infeed hood and said flame tube.

* * * * *